US007464487B2

(12) United States Patent
Boyd

(10) Patent No.: US 7,464,487 B2
(45) Date of Patent: Dec. 16, 2008

(54) SHOE COVER

(76) Inventor: Howard Boyd, 5216 N. Lantern Crest Dr., San Bernardino, CA (US) 92407

( * ) Notice: Subject to any disclaimer, the term of this patent is extended or adjusted under 35 U.S.C. 154(b) by 0 days.

(21) Appl. No.: 10/793,444

(22) Filed: Mar. 3, 2004

(65) Prior Publication Data

US 2004/0200097 A1 Oct. 14, 2004

Related U.S. Application Data

(60) Provisional application No. 60/462,126, filed on Apr. 14, 2003.

(51) Int. Cl.
*A43B 3/16* (2006.01)

(52) U.S. Cl. ..... 36/7.1 R; 36/72 R; 36/7.3; 36/136

(58) Field of Classification Search ..... 36/96, 36/72 R, 7.1 R, 7.3, 7.1 A, 114, 132, 136
See application file for complete search history.

(56) References Cited

U.S. PATENT DOCUMENTS

| | | | |
|---|---|---|---|
| 6,038,792 | A | 3/2000 | Hauter |
| D456,122 | S | 4/2002 | Hall |
| 2003/0088996 | A1 | 5/2003 | Hall |

*Primary Examiner*—Ted Kavanaugh
(74) *Attorney, Agent, or Firm*—Steins & Associates, P.C.

(57) ABSTRACT

A Shoe Cover is disclosed. Also disclosed is a cover that allows a user to decorate their athletic footwear with an outer cover. The cover has an open bottom surface to enable it to be most easily donned and doffed from the shoe. The cover further has a plurality of apertures dispersed on its bottom surface through which cleats can pass when the cover is installed. A version of the cover is provided that reaches to up the wearer's calf area. Another cover is disclosed as having a cushioned area over the laces of the shoe to prevent bruising when the user presses the top of the foot against a rigid object. Finally, a version of the cover is provided that has a reinforced tip portion, such as for soccer players.

19 Claims, 8 Drawing Sheets

SHOE COVER

This application claims priority to Provisional Application Ser. No. 60/462,126, filed Apr. 14, 2003.

BACKGROUND OF THE INVENTION

1. Field of the Invention

This invention relates generally to footwear and, more specifically, to a Shoe Cover.

2. Description of Related Art

Football, baseball and soccer are widely played traditional sports that each involve the players wearing cleated sports shoes, similar to those depicted in FIGS. 1A and 1B. FIGS. 1A and 1B are side perspective and bottom views, respectively, of a conventional cleated sports shoe 10. The shoes 10 have a (frequently leather) upper 12 terminating in a tip 20 at one end and a heel 22 at the other. The upper 12 is sewed or otherwise bonded to the sole 14, and further is generally tightly held on one's foot by laces 18. The sole 14 has several screw-in cleats 16 extending downwardly from it.

Functionally, the conventional shoe 10 is well suited to its purpose. The problem with the shoe involves issues related to the aesthetic appearance of the shoe 10. Virtually every athlete chooses their own shoes from a plethora of manufacturers, depending upon budget, fit of the shoe, durability, and other factors. While this provides great comfort to the user, it certainly doesn't lend itself to a consistent, uniform appearance from player to player. This effect is accentuated by the fact that the team members are all wearing uniforms. Also, as the shoes age, they can develop unsightly stains; the remedy is to replace the shoe, even though it is still in good functional shape.

To resolve these issues, a family of shoe covers has evolved, two examples of which are presented below in FIGS. 2A, 2B, 3A and 3B.

FIGS. 2A and 2B are side perspective and bottom views respectively, of one prior shoe cover, Hall, U.S. Patent Application Publication US2003/0088996. The Hall cover 24 has a top cuff 30 and a toe opening 26 through which the shoe tip 20 can protrude. Because the sole portion 34 of the cover 24 is closed, the cover 24 is provided with a zippered closure 32 along its top, to permit the user to more easily don and doff the cover 24. In addition to added complexity, the zipper 32 mars an otherwise clean-looking shoe cover.

FIGS. 3A and 3B are side perspective and bottom views, respectively, of another prior shoe cover, Hauter, U.S. Pat. No. 6,038,792. The Hauter cover 40, like the Hall device, has a closed sole portion 34. Like Hall, Hauter had to provide some way to enable the cover to fit the shoe snugly, but still enable the user to easily slip the cover 40 on and off the shoe 10. Hauter accomplishes this with a folded-over portion at the heel of the cover 40 that is tensioned and de-tensioned by a heel strap 44 that then attaches to a hook-and-loop fastener 46 located on the side of the cover 40. The heel strap 44, as with the zipper of Hall takes away from the aesthetic looks of the cover 40, and further creates a location for wear and inevitable failure in the cover 40.

SUMMARY OF THE INVENTION

In light of the aforementioned problems associated with the prior devices, it is an object of the present invention to provide a Shoe Cover. The cover should allow a user to decorate their athletic footwear with an outer cover. The cover should have an open bottom surface to enable it to be most easily donned and doffed from the shoe. The cover should further have a plurality of apertures dispersed on its bottom surface through which cleats can pass when the cover is installed. A version of the cover should be available that reaches to up the wearer's calf area. The cover should further be available with a cushioned area over the laces of the shoe to prevent bruising when the user presses the top of the foot against a rigid object. Finally, a version of the cover should be provided that has a reinforced tip portion, such as for soccer players.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Shoe Cover.

Figure 1A:
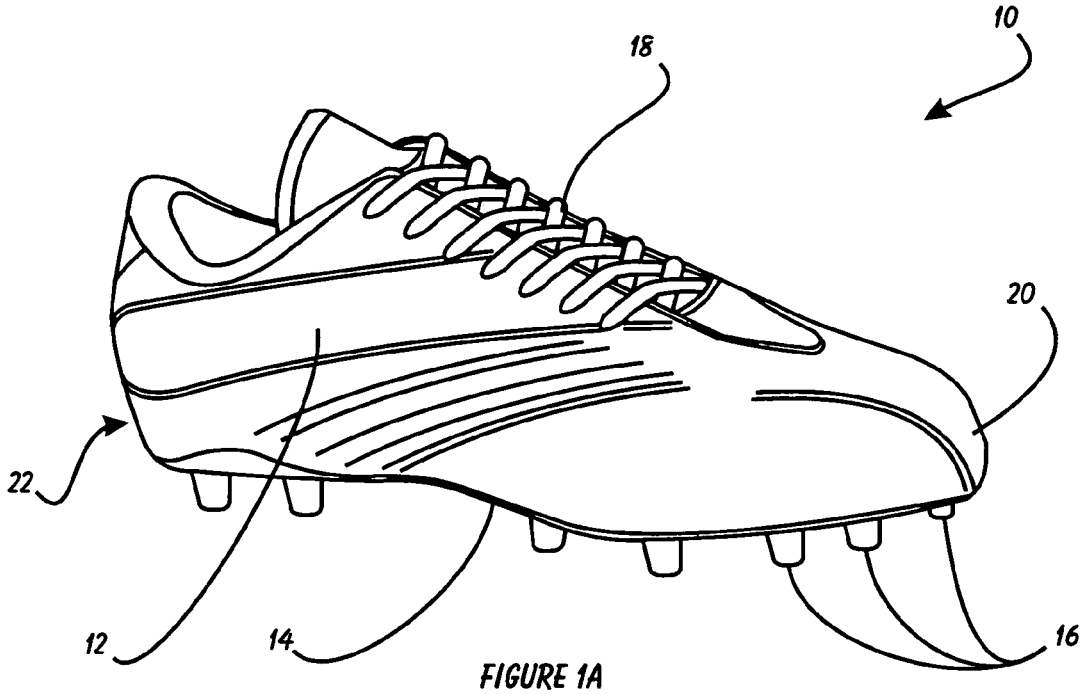
FIGURE 1A PRIOR ART
FIGS. 1A and 1B are side perspective and bottom views, respectively, of a conventional cleated sports shoe.
Figure 1B:
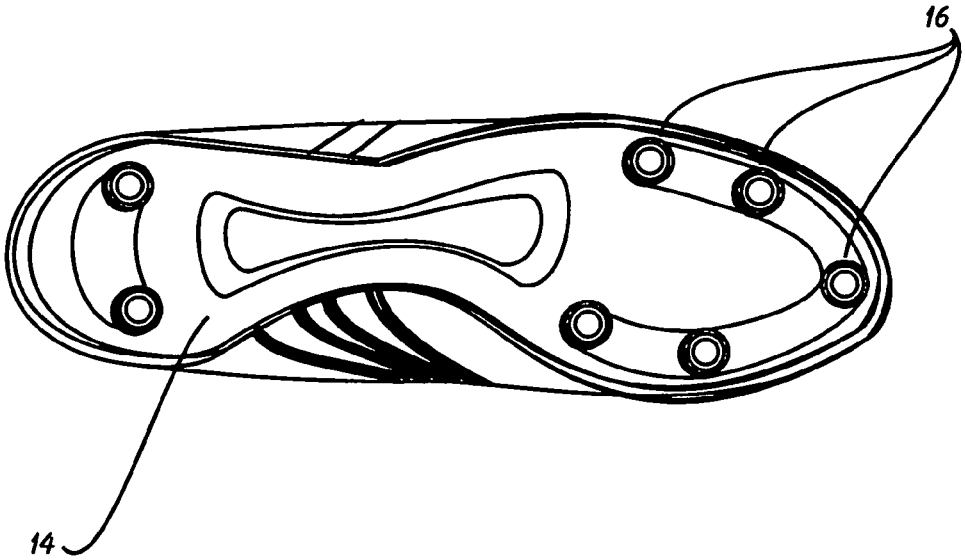
FIGURE 1B PRIOR ART
Figure 2A:
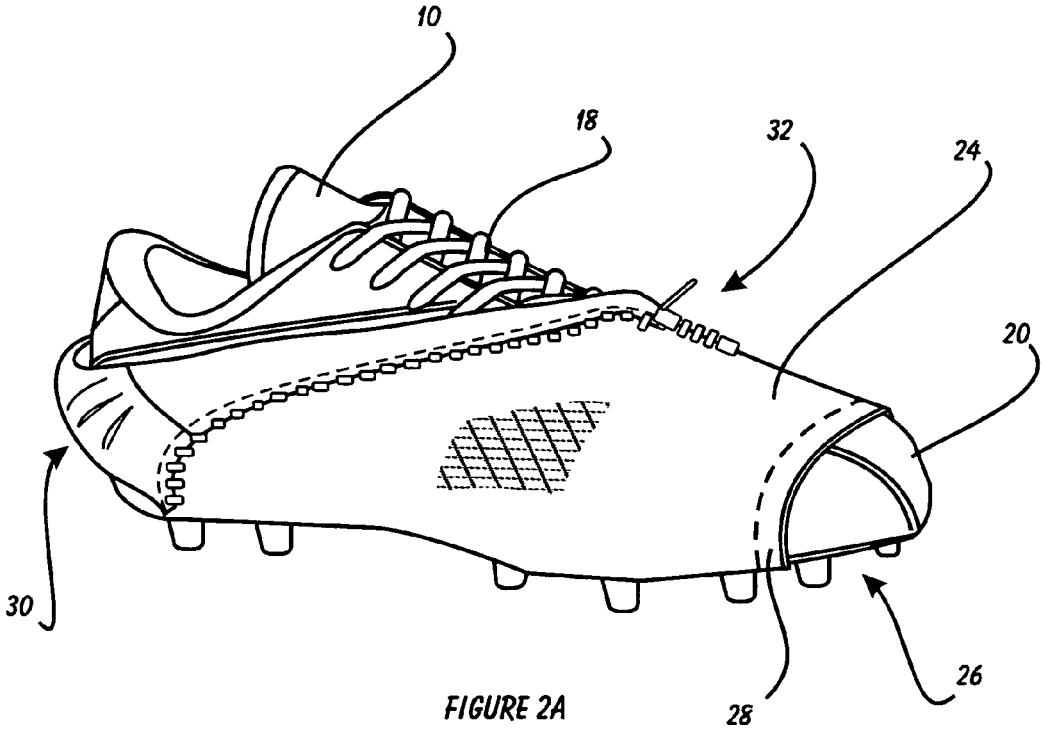
FIGURE 2A PRIOR ART
FIGS. 2A and 2B are side perspective and bottom views respectively, of one prior shoe cover.
Figure 2B:
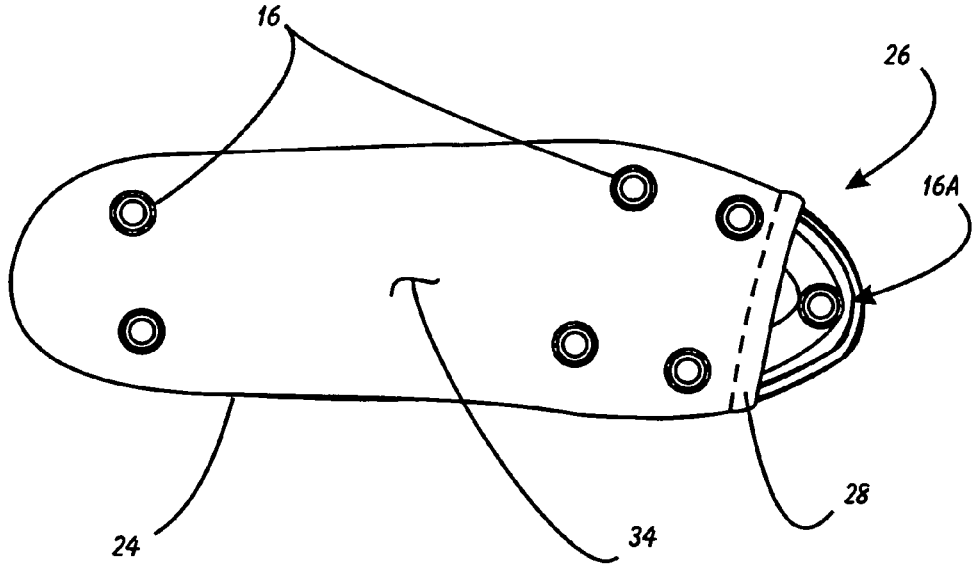
FIGURE 2B PRIOR ART
Figure 3A:
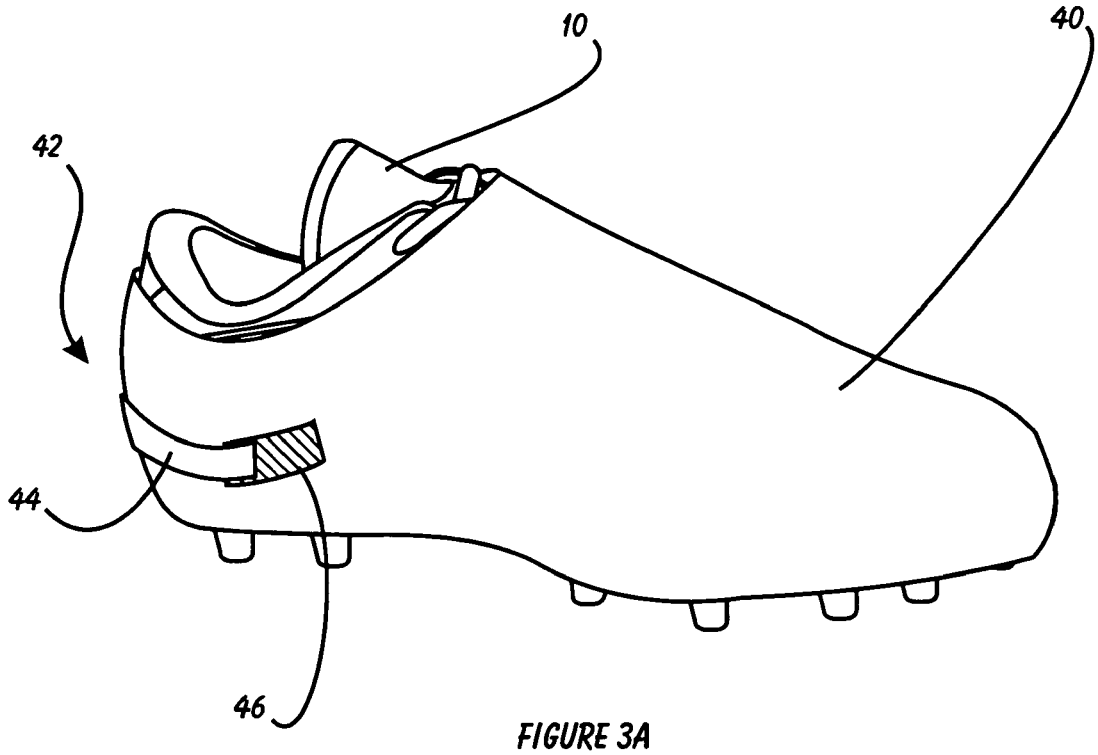
FIGURE 3A PRIOR ART
FIGS. 3A and 3B are side perspective and bottom views, respectively, of another prior shoe cover.
Figure 3B:
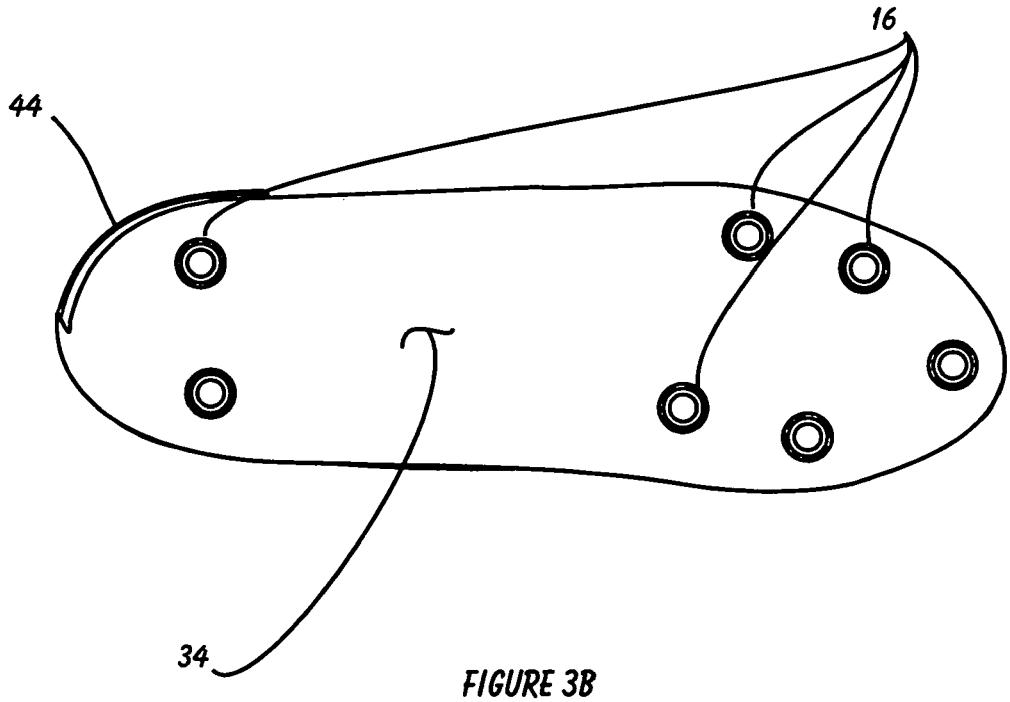
FIGURE 3B PRIOR ART
Figure 4A:
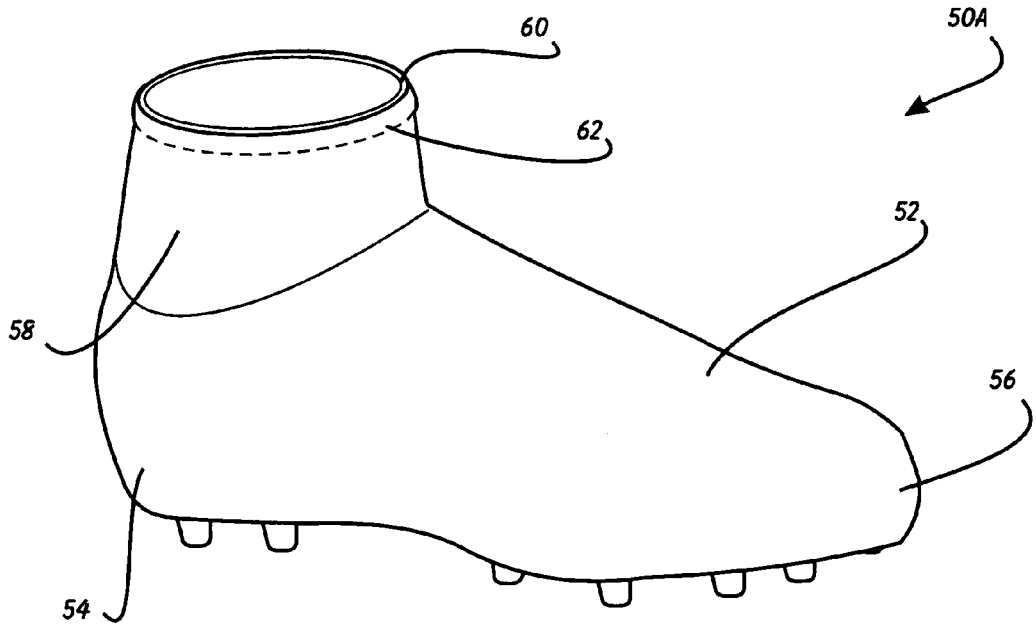
FIGS. 4A and 4B are side perspective and bottom views, respectively, of a preferred embodiment of the shoe cover of the present invention.
Figure 4B:
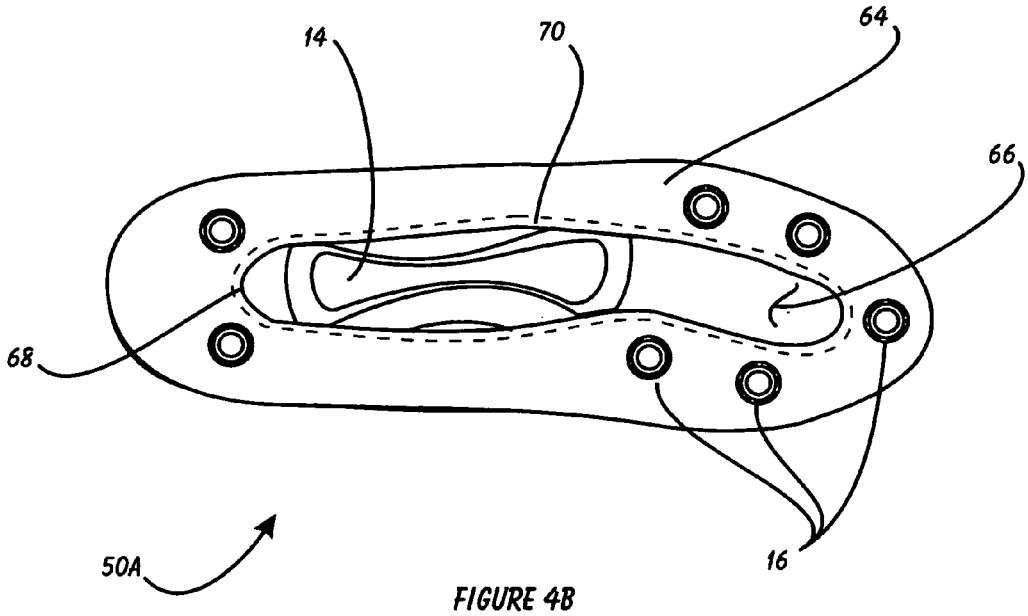

The present invention can best be understood by initial consideration of FIGS. 4A and 4B. FIGS. 4A and 4B are side perspective and bottom views, respectively, of a preferred embodiment of the shoe cover 50A of the present invention. It should be noted that throughout this description, where different versions or embodiments of the cover are discussed, they may be labeled with letters (e.g. the "A" in 50A); this is intended to convey the idea that the generic cover of the present invention is element 50, with different specific embodiments thereof being differentiated from one another by the letters.

The cover 50A is made from a stretchable, durable, and generally colorful material that will provide substantial beautification to the wearer's footwear, making the covered footwear much more attractive than if uncovered. The cover 50A is defined by an upper portion 52 that extends (unbroken) from the heel portion 54 to the tip portion 56. The upper portion transitions into a generally tubular ankle portion 58 extending upwardly therefrom. The ankle portion 58 terminates at its distal end in an upper cuff 60. The upper cuff 60 is generally formed by making a folded-over ring or hem encircling the cuff and encasing a length of elastic or rubberized material therein. The stretchable nature of the upper cuff 60 will tend to keep the ankle portion 58 up above the top of the wearer's shoe.

The sides of the ankle portion 58 and/or the top of the upper portion 52, in view of their unbroken condition (i.e. no attachment/entry openings), are particularly well-suited for placement of indicia, such a embroidery or other fabric embossing methods. This will enable, for example, schools to emboss their school logo thereon to customize and make uniform what would otherwise be conventional footwear that varies from person to person.

The upper portion 52 extends downwardly until it transitions into the sole portion 64. The sole portion 64 extends from the shoe tip to the heel, and both sides of the sole 14, but it leaves an opening in its center (the center aperture 66). The center aperture 66 permits the user to don and doff the cover 50A easily, without the need for a zippered opening on top or a clasp a the heel, as was employed in prior attempts.

The center aperture 66 has a hem substantially surrounding it, within which is a second elastic band 70, to form the sole cuff 68. The sole cuff 68 is provided to maintain tension on the material of the cover 50A, for durability, safety (prevents snags), and overall aesthetic attractiveness. The cleats 16 will protrude through apertures formed in the sole portion adjacent to the sole cuff 68 provided therefore. Now turning to FIG. 5, we can continue to examine the present invention.

Figure 5:
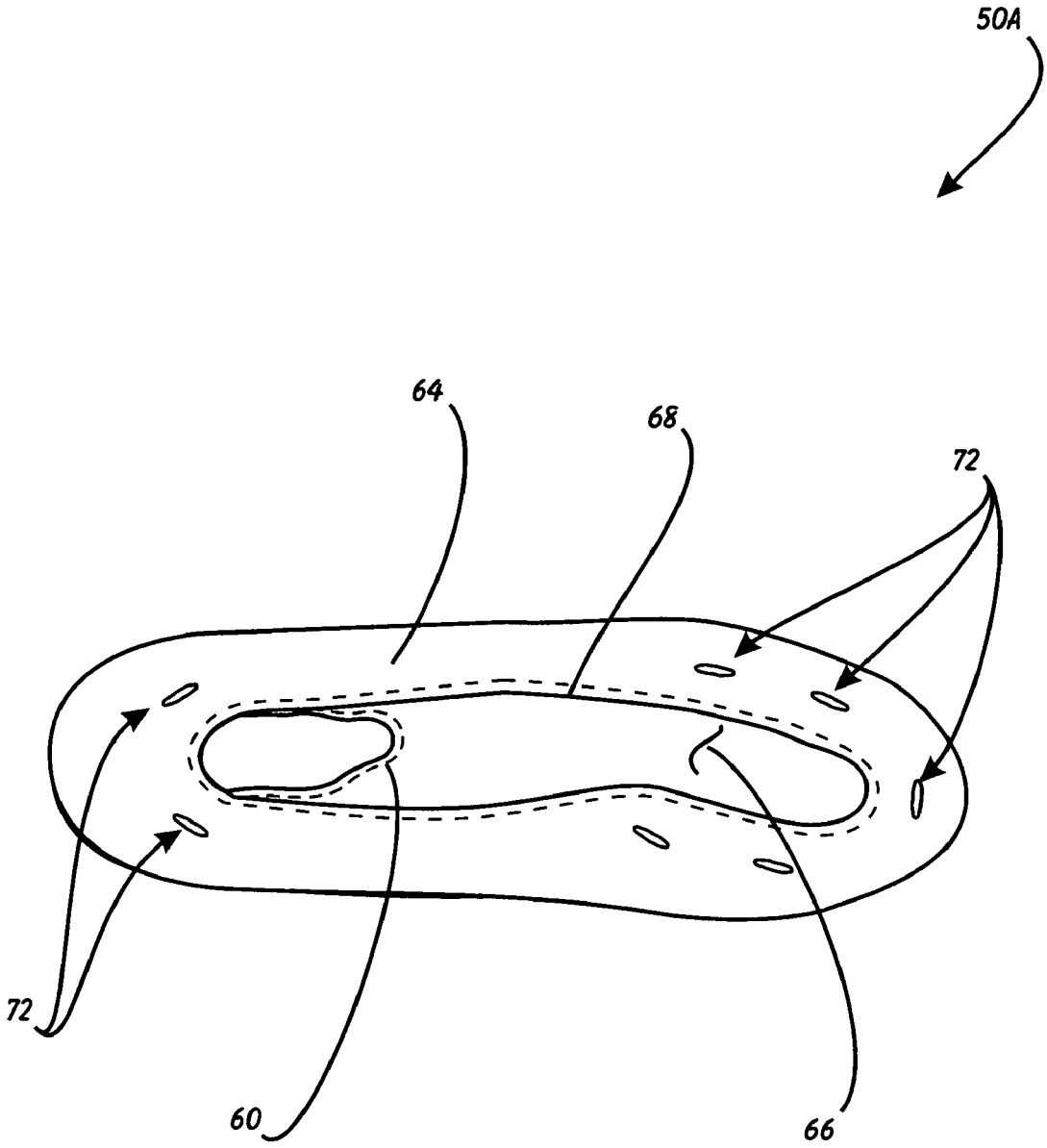
FIG. 5 is a top view of the shoe cover of FIGS. 4A and 4B.
Figure 6:
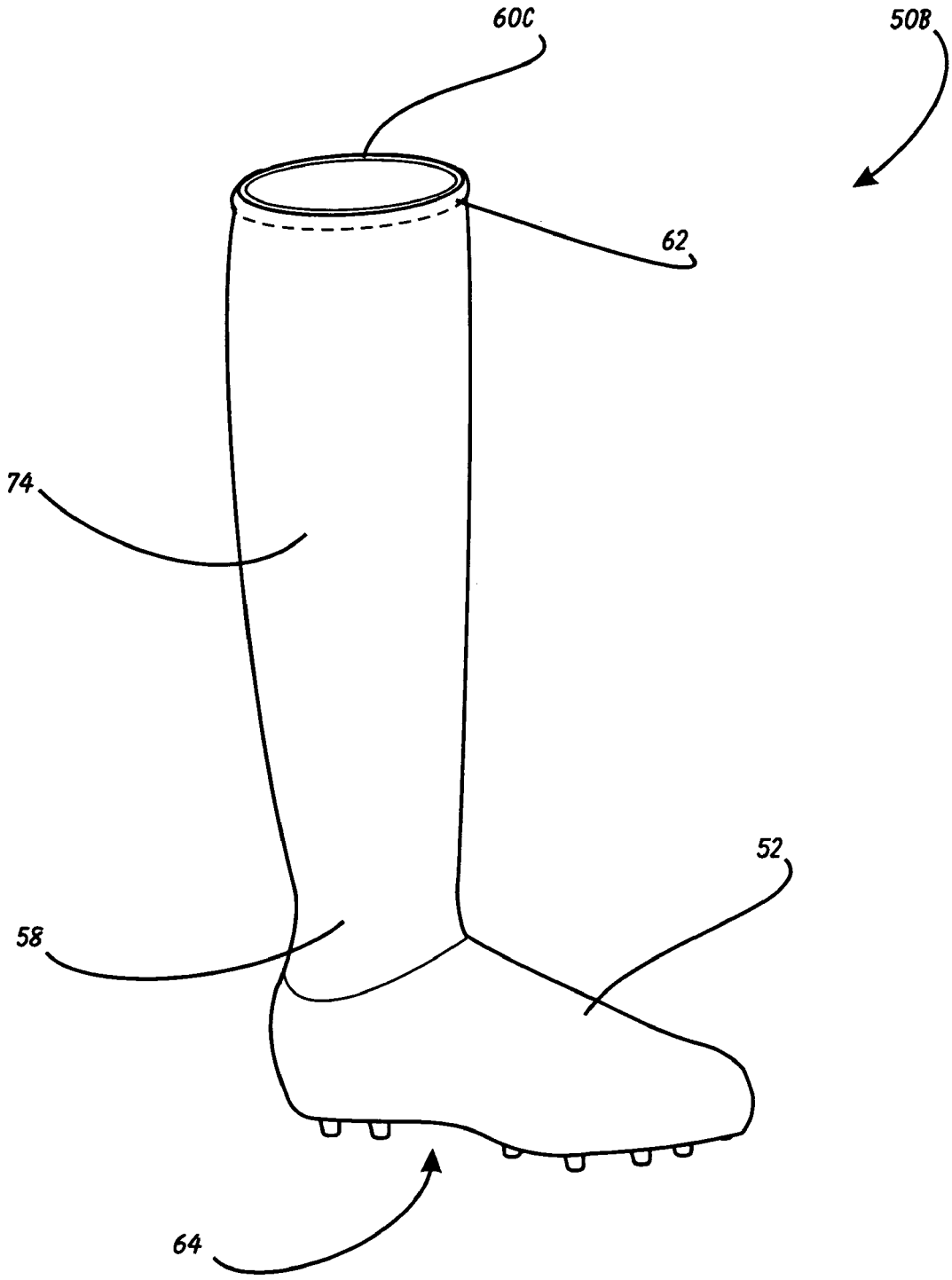
FIG. 6 is a side perspective view of an alternate embodiment of the shoe cover of the present invention.

FIG. 5 is a top view of the shoe cover 50A of FIGS. 4A and 4B. As shown, a plurality of cleat apertures 72 encircle the sole cuff 68, to correspond to the locations of the cleats in the particular model of shoe to be covered by the cover 50A. If desired, the user can create additional apertures 72 in the sole portion 64 in order to accommodate custom cleat locations. Turning to FIG. 6, another version of the present invention can be examined.

FIG. 6 is a side perspective view of an alternate embodiment of the shoe cover 50B of the present invention. This version of the cover 50B is, essentially, a shoe cover and a matching decorative stocking combined. Instead of terminating with the ankle portion 58, this version 50B has an elongated tubular calf portion 74 extending upwardly from the ankle portion 58. The calf portion 74 could be made from the same material and color as the rest of the cover 50B, or it could be made from a different material or color, in order to provide additional functionality and perhaps utility.

The upper cuff 60 is located at the distal end of the calf portion 74, and is defined by an elastic band 62 substantially encircling it and being encased in a hem. Finally, turning to FIGS. 7A and 7B, we can look at yet another version of the cover.

Figure 7A:
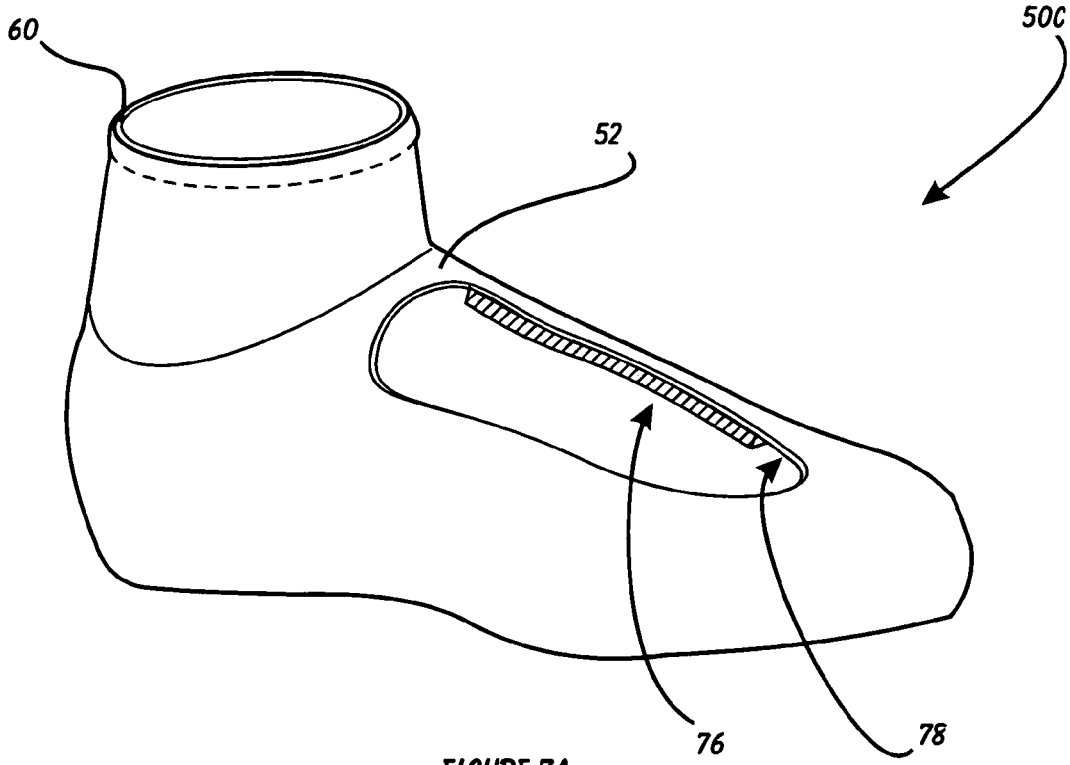
FIGS. 7A and 7B are side perspective and bottom views, respectively, of another alternate embodiment of the shoe cover of the present invention.
Figure 7B:
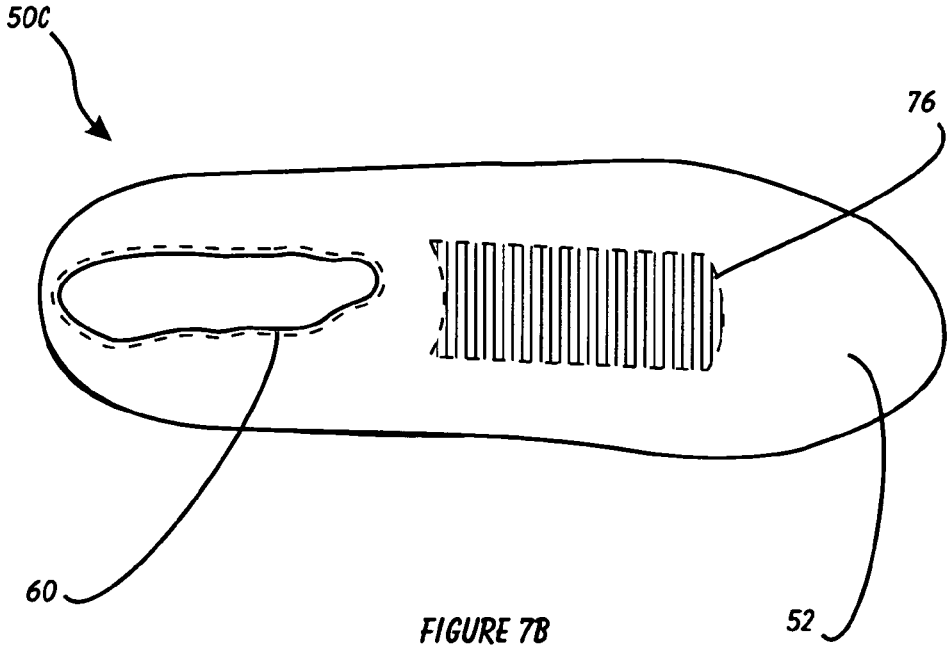

FIGS. 7A and 7B are side perspective and bottom views, respectively, of another alternate embodiment of the shoe cover 50C of the present invention. This cover provides additional functionality for somewhat non-traditional sports, such as motorcycle riding. The cover 50C has a cushion member 76 attached to the top inside surface 78 of the upper portion 52 of the cover 50C. The cushion member 76 gives the wearer additional comfort, particularly for the foot being used to shift the gears on the motorcycle, by providing a thicker protective layer across the somewhat sensitive top of the person's foot. Of course, the cushion member 76 could be attached to the inside or outside surface of the cover 50C, and it further could be a thickening of material in the top area of the cover, or a piece inserted into a cutout in the cover 50C. By placing the cushion member 76 on the inside, the outer surface of the cover 50C is unblemished and more attractive.

Figure 8:
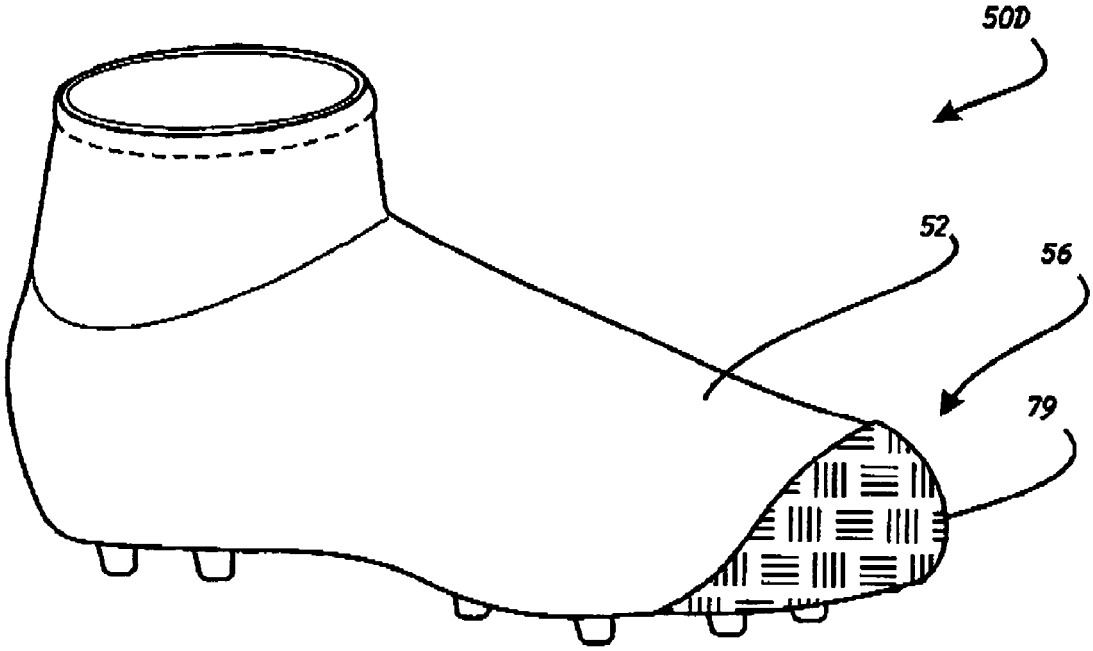
FIG. 8 is a perspective view of yet another preferred embodiment of the shoe cover of the present invention.

FIG. 8 depicts yet another embodiment of the shoe cover of the present invention 50D. This version has a protective sheath 78 applied to the tip 52 of the cover 50D. The sheath 78 is a sort of tip guard to prolong the longevity of the cover 50D, such as for kicking applications like soccer. The sheath 79 could be made from rubber or plastic or other durable material.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cover for shoes, comprising:

an upper portion defined by an unbroken field of flexible material extending from a tip end to a heel end and further defined by an upper end and a lower end;

an ankle portion extending upwardly from adjacent to said heel end, said ankle portion defining an upper cuff at an end distal to said upper portion;

a sole portion extending between said tip end and said heel end of said lower end of said upper portion, said sole portion defined by a single center aperture, said single center aperture defined at its perimeter by a sole cuff, said sole cuff substantially encircled by a band of elastic material.

2. The cover of claim 1, wherein said sole portion is further defined by at least two cleat apertures formed through said sole portion in spaced relation said sole cuff.

3. The cover of claim 2, wherein said upper cuff is substantially encircled by a band of elastic material.

4. The cover of claim 3, further defined by a generally tubular elongate calf portion extending upwardly from said ankle portion at one end, and defined by said upper cuff at an end that is distal to said ankle portion.

5. The cover of claim 3, comprising at least two heel cleat apertures positioned on said sole portion in spaced relation between said heel portion and said sole cuff.

6. The cover of claim 5, comprising a least three toe cleat apertures positioned on said sole portion in spaced relation generally between said toe portion and said sole cuff.

7. The cover of claim 3, wherein said upper portion defines a top inside surface, said cover farther comprising a cushion member attached to said top inside surface.

8. A cover for cleated footwear, the footwear defined by an upper having a tip and a heel, a sole, and two or more cleat protrusions extending downwardly from said sole, the cover comprising:

an upper portion defined by an unbroken section of flexible material covering said upper to extend from said tip to said heel;

an ankle portion extending upwardly from said ankle portion adjacent to said heel, said ankle portion defining an upper cuff at its distal end; and a sole portion extending between a tip end of said upper portion and a heel end of said upper portion, said sole portion comprising a sole cuff defined by a single center aperture, said sole cuff having a sole hem formed thereabout and a band of elastic material encased in said sole hem.

9. The cover of claim 8, wherein said sole portion is further defined by at least two cleat apertures formed through said sole portion adjacent and in spaced relation to said sole cuff.

10. The cover of claim 9, wherein said upper cuff is substantially encircled by an upper hem and a band of elastic material substantially encased in said upper hem.

11. The cover of claim 10, further defined by a generally tubular elongate calf portion extending upwardly from said ankle portion at one end, and defined by said upper cuff at a distal end.

12. The cover of claim 11, comprising at least two heel cleat apertures positioned on said sole portion in spaced relation between said heel portion and said sole cuff.

13. The cover of claim 12, comprising a least three toe cleat apertures positioned on said sole portion in spaced relation generally between said toe portion and said sole cuff.

14. The cover of claim 13, comprising a least three toe cleat apertures positioned on said sole portion in spaced relation generally between said toe portion and said sole cuff.

15. The cover of claim 10, comprising at least two heel cleat apertures positioned on said sole portion in spaced relation between said heel portion and said sole cuff.

16. The cover of claim 15, wherein said upper portion defines a top inside surface, said cover further comprising a cushion member attached to said top inside surface.

17. The cover of claim 8 further comprising a sheath disposed on said upper portion in the vicinity of said tip.

18. The cover of claim 8, further comprising a plurality of cleat apertures formed through said sole portion adjacent to said sole cuff; said cleat apertures in relative spaced relation to substantially encircle said sole cuff.

19. The cover of claim 18, wherein said cleat apertures are generally circular in shape and are cooperatively sized to accept said cleat protrusions therethrough.

* * * * *